United States Patent [19]

Matthews et al.

[11] Patent Number: 4,832,211

[45] Date of Patent: May 23, 1989

[54] CONTAINER FOR LIQUIDS

[75] Inventors: Walter A. Matthews, Rothesay; Edward B. MacDormand, Saint John, both of Canada

[73] Assignee: Irving Oil Limited, St. John, Canada

[21] Appl. No.: 44,493

[22] Filed: Apr. 30, 1987

[30] Foreign Application Priority Data

Mar. 9, 1987 [CA] Canada ..... 531,524

[51] Int. Cl.[4] ..... B65D 1/02; B65D 23/04; F16N 3/04

[52] U.S. Cl. ..... 215/1 C; 215/365; 206/459; 206/822; 222/572

[58] Field of Search ..... 215/1 C, 1 R, 365, 100 R; 220/855 P; 222/460, 462, 566, 572; D9/367, 389; 206/822, 459

[56] References Cited

U.S. PATENT DOCUMENTS

| | | | |
|---|---|---|---|
| D. 281,577 | 12/1985 | Larson et al. | 215/1 C X |
| 2,831,594 | 4/1958 | Sterges et al. | 215/1 R |
| 2,920,777 | 1/1960 | Cole | 215/1 C |
| 2,978,131 | 4/1961 | Garvey | 215/1 R |
| 3,225,950 | 12/1965 | Josephsen et al. | 215/1 C |
| 3,589,542 | 2/1970 | Dillon | 215/1 R |
| 4,046,275 | 9/1977 | Virog, Jr. et al. | 215/1 C |

FOREIGN PATENT DOCUMENTS

| | | | |
|---|---|---|---|
| 2540090 | 3/1977 | Fed. Rep. of Germany | 215/1 C |

*Primary Examiner*—Sue A. Weaver

*Attorney, Agent, or Firm*—Mason, Fenwick & Lawrence

[57] ABSTRACT

There is provided a new and useful bottle for containing and pouring liquids comprising a body section having bottom, front, back and first and second sides, and a neck section, the first side including a lower section, and an upper elongated sloped shoulder section narrowing progressively to intersect the neck section at a first line of intersection, the second side including a lower section, and an upper sloped shoulder section narrowing progressively to intersect the neck section along a second line of intersection at a higher level on the neck than the first line of intersection; and each of the front and back including a lower section and an upper sloped section joining the edges of the first and second sides and intersecting the neck section.

16 Claims, 2 Drawing Sheets

CONTAINER FOR LIQUIDS

This application relates to a unique bottle for containing and pouring liquids.

BACKGROUND OF THE INVENTION

As long as there have been containers from which liquids are to be poured, there have been various problems inherent in that apparently simple procedure. This has most clearly been the case where it is required to pour a liquid from a full container into some other holding device. An example of such a procedure is the pouring of oil from a container into the oil filler pipe of an internal combustion engine. This example will be utilized throughout this disclosure as a means of illustrating the invention.

The filler cap for an internal combustion engine is normally in the valve cover located atop the engine and spaced somewhat from the engine edge. A number of problems arise in transferring oil from a standard one quart or one litre container into the filler pipe. First, since the pipe is not normally located at the side of the engine, the bulk of the container for pouring must be positioned above the engine, and as a result the pouring spout or neck is considerably removed from the filler pipe. At such a distance it is difficult to ensure that the initial pouring from the oil container will find its way into the filler pipe rather than onto the top of the engine. For this reason there is very frequently at least a small amount of spillage.

Furthermore, there is a real tendancy, once pouring has started, to rapidly invert the container and insert the spout or neck which is normally somewhat extended for this purpose right into the filler pipe to avoid further spillage. This movement adds to the difficulties, since the design of conventional containers is such that any rapid degree of inversion will quickly result in oil filling the spout or neck. This in turn means that air must bubble up through the oil into the container as the container begins to empty. The uneven flow caused by the movement of air up into the container—sometimes referred to as "gurgling"—results in such turbulance at the spout that additinal spillage is very likely to occur. This gurgling will frequently occur before the spout or neck of the container is sufficiently inverted to be inserted completely into the filler pipe.

The problem just discussed is one of very long standing. Numerous attempts have been made over the years to solve the problem. For example, some years ago when motor oil was largely still sold in tins, funnels were provided with integral can openers, so that the funnel could be placed in the filler pipe and then the oil tin opened by partially inserting it into the top of the funnel. This served very well to avoid spillage during the initial pouring stage but frequently resulted in some dripping and general messiness when the funnel was removed from the filler pipe and the oil tin from the funnel. This combination was undesirable for individual consumer use, since the storage of the oily funnel was a problem between uses.

With the advent of blow molded plastic containers, the disposal problem was not so serious, since the used container could simply be closed with its screw cap for disposal once the oil had been emptied into the filler pipe. Unfortunately, with this type container the problems with the initial pouring phase became much more serious.

The extent of this problem is such that it can be considered to be the norm at present that some spillage takes place when oil is added to an engine filler pipe from a blow molded container. The importance of consumer acceptance in this regard is of critical importance. As a result, there is a very concerted effort underway by those concerned to develop a container which will avoid the problems discussed. To date, while various modifications of a blow molded container have been offered, some reaching the market, nonetheless it is generally felt that an adequate solution has not yet been achieved. Such a solution is being actively sought.

It is against this background that the present invention arises. A liquid container has now been provided which materially reduces spillage in the initial pouring phase and contributes markedly to the avoidance of spillage in the later phases of pouring. The container permits the pouring spout or neck to be initially placed much closer to the filler pipe than has heretofore been the case to initiate pouring. Once pouring does commence, the container permits a smooth pouring action without gurgling over a substantial angle of rotation of the container. The container therefore reduces initial spillage by allowing for closer alignment between the spout or neck and the filler pipe and then permits the entirety of the spout or neck to be inserted into the filler pipe before gurgling action occurs.

PRIOR ART

The applicant is unaware of any prior art which is directed at the solution of the combination of problems to which reference is made above. However, of some interest is U.S. Pat. No. 2,978,131, issued Apr. 4, 1961, to Garvey. That patent relates to a bottle structure in which a hollow handle is utilized to promote a smooth flow of air into the bottle and liquid out of the bottle during pouring. Similarly, U.S. Pat. No. 4,046,275, issued Sept. 6, 1977, to Virog, et al., deals with a bottle design in which an angled face and a hollow handle combine to aid in air flow during pouring.

SUMMARY OF THE INVENTION

The present container has a unique shape which permits a pouring spout or neck to be placed closer to a receiving container into which the contents of a pouring container is to be emptied before pouring commences and which enhances the smoothness of pouring once pouring does commence.

Thus, the invention provides a container for liquids comprising a body section having bottom, front, back and first and second sides, and a neck section, the first side including a lower section, and an upper elongated sloped shoulder section narrowing progressively to intersect the neck section at a first line of intersection, the second side including a lower section, and an upper sloped shoulder section narrowing progressively to intersect the neck section along a second line of intersection at a higher level on the neck than the first line of intersection; and each of the front and back including a lower section and an upper sloped section joining the edges of the first and second sides and intersecting the neck section.

BRIEF DESCRIPTION OF THE DRAWINGS

In the drawings which illustrate embodiments of the invention.

Figure 1:
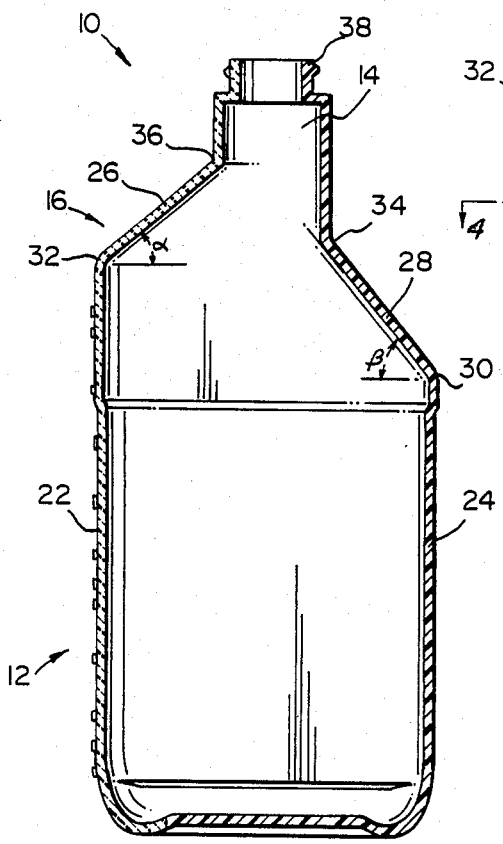
FIG. 1 is a vertical section through a container according to the invention taken on the line 1—1 of FIG. 3.
Figure 2:
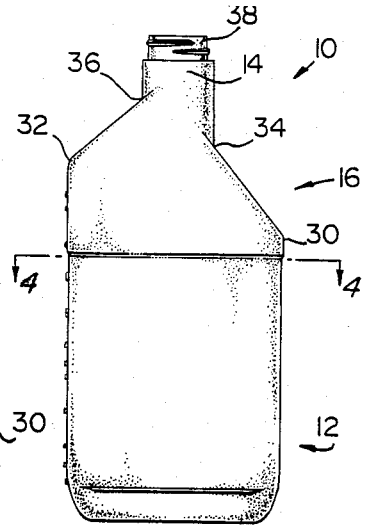
FIG. 2 is a front elevation of a container according to the invention.
Figure 3:
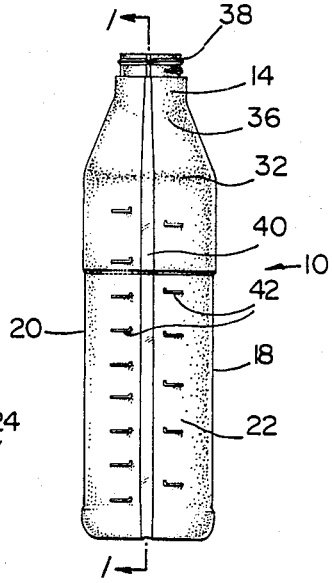
FIG. 3 is a side elevation of a container according to the invention.

While the invention will be described in conjunction will illustrated embodiments, it will be understood that is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The container 10 comprises a lower body section 12 and a somewhat elongated neck 14 with a discharge opening at the outer end. The neck 14 is joined to body 12 by a shoulder section 16.

Figure 4:
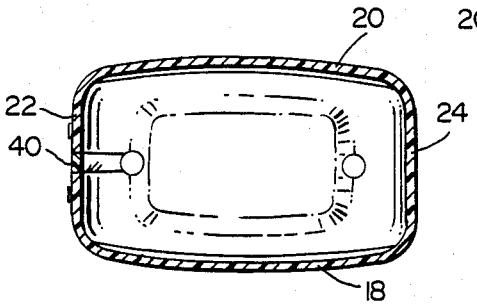
FIG. 4 is a horizontal section through a container according to the invention taken on the line 4—4 of FIG. 2.

The lower body section 12 is of generally rectangular configuration is horizontal cross-section, and includes the identical front and back panels 18 and 20 and the two side panels 22 and 24. The front and back panels 18 and 20 are substantially parallel, although they are not precisely planar (see FIG. 4), and the two side panels 22 and 24 are substantially parallel, and are substantially perpendicular top the front and back panels 18 and 20. The panel 24 is noticeably shorter than panel 22. The panel 22 is joined to neck 14 by shoulder section 26, and panel 24 is joined to neck 14 by shoulder section 28.

The line of intersection 30 of the shoulder 28 with side panel 24 is substantially lower than the line of intersection 32 of the shoulder section 26 with the side panel 22. A similar relationship exists between the line of intersection 34 between shoulder section 28 and neck 14 and line of intersection 36 between shoulder section 26 and neck 14. Thus, effectively, shoulder section 28 has a dropped configuration whereas the shoulder section 26 has a raised configuration. The neck 14 is configured to accommodate the offset shoulder levels and is preferably extended above the line of intersection 36 having a greater length above the line of intersection 34 than above the line of intersection 36. In addition, neck 14 includes a threaded upper section 38.

In a typical case the angle $\alpha$ at which shoulder section 26 is sloped relative to the horizontal when the container is in the upright position will be in the range 35 to 50 degrees and preferably about 40 degrees. The angle $\beta$ at which shoulder section 28 is sloped relative to the horizontal, as with angle $\alpha$, will be in the range 45 to 60 degrees and preferably about 50 degrees.

In the case of a typical one litre container, the dimensions of the lower section 12 will be about 4.5 by about 2.5 inches.

For convenience of monitoring pouring, the side 22 and shoulder section 26 are preferably provided with a transparent window section 40 and marked gradations 42.

The preferred maximum fill level for a container according to the invention will be below the line of intersection 36 of the shoulder section 26 with the neck 14 and most preferably just below the line of intersection 34 of shoulder section 28 with neck 14.

With reference to FIG. 5, the series of drawings making up that figure illustrate the pouring sequence utilizing a container according ot the invention and the advantages to be derived therefrom. The structure 44 represents the valve cover normally located on the top of an internal combustion engine. An oil filler opening 46 is normally located in the top of valve cover 44. There are various configurations at the top of internal combustion engines and the top mounted opening 46 may occasionally vary as well. Nonetheless, in the vast majority of cases the representation in FIG. 5 is reasonably accurate. In most cases there is sufficient room beside the valve cover 44 in the area of the oil filler opening 46 to allow the container 10 to be lowered to the position illustrated in FIG. 5*b*.

Figure 5A:
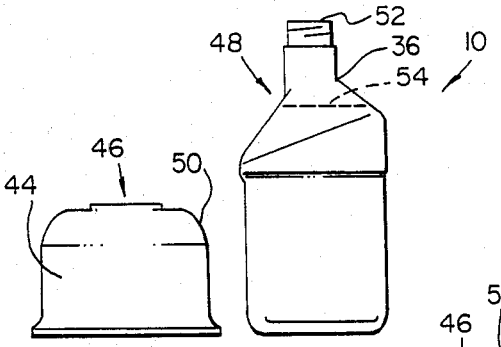
FIGS. 5*a* to 5*e* illustrate a pouring sequence utilizing a container according to the invention.
Figure 5B:
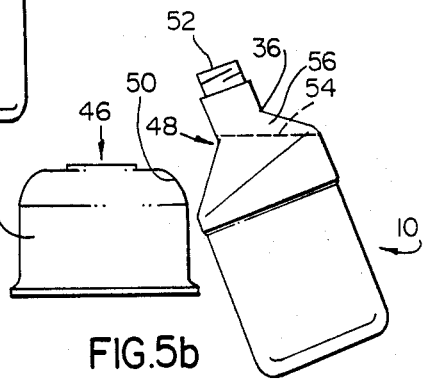
Figure 5C:
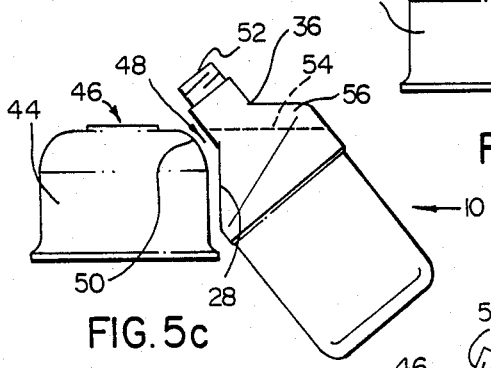

As illustrated in FIG. 5*c*, the container 10 can be tipped so that the indented area 48 defined by the neck 14 and the dropped shoulder section 28 receives the shoulder 50 of valve cover 44. At this point the top 52 of container 10 is located very close to the oil filler opening 46 in valve cover 44. At the same time the liquid level 54 in container 10 is still well below the top 52, so that pouring has not yet commenced.

Figure 5D:
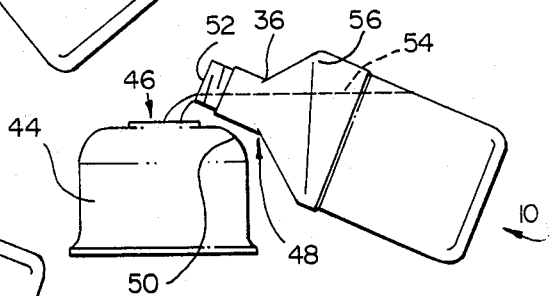
Figure 5E:
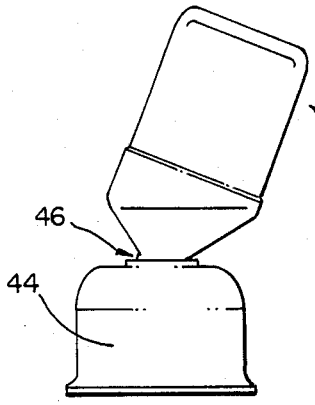

Further tipping of the container as illustrated in FIG. 5*d* enables puring to commence at a point where the top 52 of container 10 is in very close proximity to oil filler opening 46.

At this point the liquid level 54 is below the line of intersection 36 between shoulder section 26 and neck 14. This allows for entry of air into the upper area 56 above the liquid level 54 in container 10.

In the preferred case the neck 14 is of relatively large diameter, so that a very substantial flow rate can be achieved of liquid from the container before the neck becomes filled with liquid and gurgling commences. This feature aids in providing time for the container to be inverted from the position in FIG. 5*d* to the position in FIG. 5*e* without gurgling taking place between the two positions. This is important because it enables a user to begin pouring and properly place the top 52 of container 10 as illustrated in FIG. 5*d* and to then invert the container to the FIG. 5*e* position without interim spillage caused by premature gurgling. Thus, the neck diameter may be in the range of 28 to 38 millimetres and in the preferred case will be about 33 millimetres.

The raised line of intersection between shoulder section 26 and neck 14 enables this clear air flow passage to develop as pouring commences and continues. The relationship between the parts of the container and their contribution to the combined advantages are complex but can be explained schematically in relatively simple terms and by following the pouring sequence of FIG. 5. As a means of placing the top 52 of the container 10 in proximity to the filler opening 46, the dropped shoulder on the pouring side of the container 10 is combined with the relatively elongated neck 14. It is clear from FIGS. 5*c* and 5*d* how this combination achieves its purpose.

The very important factor for consideration in achieving the position of FIG. 5*c* is the effect on the liquid level of the initial tipping of the container. The liquid level may be viewed as a line which rotates as the container is tipped. As the liquid level line rotates, it will sweep on the pouring side of the container a volume which was formerly air space and will sweep on the side opposite to the pouring side of the container a volume which was formerly liquid filled. The relationship between these two volumes will dictate the positional variation of the liquid level line. As long as the volume of air space swept by the liquid level line is equal to or greater than the volume of liquid space swept by that line, the liquid level will not be forced up the neck, and a greater degree of tipping can be achieved before pouring commences. If the volume of liquid swept by the line is greater than the volume of air swept, the liquid level will begin to take up additional air space in the neck of the container and pouring will commence much sooner. If the shoulder section 26 were initially horizontal, and the liquid level were at or near the line of intersection 36, very little rotation of the container would cause the liquid level line to sweep the substantial volume of oil in the shoulder on the one side and only a small amount of air space in the neck on the other side. In simple terms the oil in the shoulder would then simply fall down and flow out the neck. By dropping the shoulder opposite to the pouring side of the container, the amount of liquid displaced by the initial rotation of the liquid level line is substantially reduced. As well, if a relatively large diameter neck 14 is utilized, additional air space is provided to offset the swept oil volume before pouring commences.

Furthermore, when the dropped shoulder on the side opposite to the pouring side is complimented by a raised line of intersection 36 with neck 14, the period before which the line of liquid level will reach that line of intersection, thus filling the neck and causing gurgling, is lengthened. Not only does that raised line of intersection allow for a smooth ingress of air during initial pouring stages, but that air flow path is maintained for a longer period.

Thus it is apparent that there has been provided in accordance with the invention a unique bottle for containing and pouring liquids that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A container for liquids comprising:

a body section having a bottom, a front and back, and substantially parallel, first and second sides substantially perpendicular to said front and back adjacent said bottom; and a neck section;

said first side including a lower section, and an upper elongated sloped shoulder section narrowing progressively to intersect said neck section at a first line of intersection;

said second side including a lower section, and an upper sloped shoulder section narrowing progressively to intersect said neck section along a second line of intersection, said second line of intersection being at a higher level on said neck section than said first line of intersection;

said container normally utilized to pour the contents with the first side bottom-most and being substantially free of means for assisting in pouring the contents from said container with said first side bottom-most, said neck section having a greater length above said first line of intersection than above said second line of intersection, each of said front and back including a lower section and an upper sloped section joining the edges of said first and second sides and intersecting said neck section.

2. The container of claim 1 in which the lower section of said second side is of greater height than the lower section of said first side.

3. The container of claim 2 in which the elongated sloped shoulder of said first side has a greater angle of slope than said sloped shoulder of said second side.

4. The container of claim 3 in which said elongated sloped shoulder of said first side is at an angle of approximately 45 to 60 degrees to the horizontal.

5. The container of claim 4 in which said sloped shoulder of said second side is at an angle of approximately 35 to 50 degrees to the horizontal.

6. The container of claim 3 in which said elongated sloped shoulder of said first side is at an angle of 50 degrees to the horizontal and said sloped shoulder of said second side is at an angle of 40 degrees to the horizontal.

7. The container of claim 5 in which said neck section extends beyond said second line of intersection.

8. The container of claim 7 in which all said lower sections are of substantially rectangular configuration.

9. The container of claim 1, and further comprising liquid therein with the upper surface thereof no higher than said second line of intersection when said bottom is substantially horizontal.

10. The container of claim 9, in which the liquid upper surface is approximately at said first line of intersection.

11. The container of claim 9, wherein said liquid upper surface lies between said first and second lines of intersection.

12. The container of claim 1 in which the axis of said neck section is centrally located relative to the sides of said container.

13. A container for liquids comprising:

a body section having bottom, front, back and first and second sides; and a neck section;

said first side including a lower section, and an upper elongated sloped shoulder section narrowing progressively to intersect said neck section at a first line of intersection;

said second side including a lower section, and an upper sloped shoulder section narrowing progressively to intersect said neck section along a second line of intersection, said second line of intersection being at a higher level on said neck section than said first line of intersection;

the lower section of said second side being of greater height than the lower section of said first side;

each of said front and back including a lower section and an upper sloped section joining the edges of said first and second sides and intersecting said neck section.

14. A container for liquids comprising:

a body section having a bottom, front and back, and first and second sides; and a neck section;

said first side including a lower section, and an upper elongated sloped shoulder section intersecting said neck section at a first line of intersection;

said second side including a lower section, and an upper sloped shoulder section intersecting said neck section along a second line of intersection;

said second line of intersection being at a higher level on said neck section than said first line of intersection;

said neck section having a greater length above said first line of intersection than above said second line of intersection;

each of said front and back joining said first and second sides and intersecting said neck section;

said container below said first line of intersection being of substantially rectangular horizontal cross-section;

said container being substantially free of a protrusion above the shoulder section of said first side and of means for assisting in pouring the contents from said container with the first side bottom-most.

15. A container for liquids comprising:

a body section having a bottom, front and back, and substantially parallel first and second sides substantially perpendicular to said front and back adjacent said bottom; and a neck section having a discharge opening at the outer end thereof;

said first side including a lower section and means for providing an indented area in said first side for enabling the discharge opening of the neck of the container to be located close to a filling opening into which liquid in the container is to be poured comprising an upper elongated sloped shoulder section intersecting said neck section at a first line of intersection;

said second side including a lower section, and an upper sloped shoulder section intersecting said neck section along a second line of intersection;

each of said front and back joining said first and second sides and intersecting said neck section;

means for permitting entry of air into said container during the initial tilting of said container with said first side bottom-most to pour out the contents thereof without blockage of the neck section by contents of the container comprising said second line of intersection being at a higher level on said neck section than said first line of intersection; and said neck section having a greater length above said first line of intersection than above said second line of intersection.

16. The container of claim 15, said neck section being substantially perpendicular to said bottom.

* * * * *